US008424834B2

(12) United States Patent
Crane

(10) Patent No.: US 8,424,834 B2
(45) Date of Patent: Apr. 23, 2013

(54) COMPOSITE APPLIANCE BASE

(75) Inventor: Michael Crane, Rochester, MI (US)

(73) Assignee: Magna International, Aurora (CA)

( * ) Notice: Subject to any disclaimer, the term of this patent is extended or adjusted under 35 U.S.C. 154(b) by 342 days.

(21) Appl. No.: 12/821,535

(22) Filed: Jun. 23, 2010

(65) Prior Publication Data

US 2010/0327127 A1 Dec. 30, 2010

Related U.S. Application Data

(60) Provisional application No. 61/269,370, filed on Jun. 24, 2009.

(51) Int. Cl.
*F16M 11/10* (2006.01)
*A47G 1/00* (2006.01)

(52) U.S. Cl.
USPC ..... 248/678; 248/346.01; 248/316.7; 34/260; 34/596

(58) Field of Classification Search ..... 248/346.01, 248/639, 645, 346.06, 674–678, 316.7, 63, 248/68.1, 74.2; 34/329, 211, 260, 596, 601–607, 34/132, 121; 62/414, 419, 441
See application file for complete search history.

(56) References Cited

U.S. PATENT DOCUMENTS

| | | | | |
|---|---|---|---|---|
| 3,722,845 | A | 3/1973 | Unger | |
| 5,277,395 | A | 1/1994 | Smith et al. | |
| 5,333,830 | A | 8/1994 | Millen | |
| 5,374,118 | A * | 12/1994 | Kruck et al. | 312/407 |
| 5,950,980 | A | 9/1999 | Folmar | |
| 6,009,238 | A * | 12/1999 | Belongia | 392/444 |
| 6,874,248 | B2 * | 4/2005 | Hong et al. | 248/675 |
| 6,912,766 | B2 | 7/2005 | Wendt et al. | |
| 7,266,956 | B2 | 9/2007 | Norrell et al. | |
| 7,334,421 | B1 | 2/2008 | Cantolino | |
| 7,406,780 | B2 * | 8/2008 | Doh et al. | 34/606 |
| 7,627,960 | B2 * | 12/2009 | Beyerle et al. | 34/602 |
| 8,051,580 | B2 * | 11/2011 | Bruneau et al. | 248/677 |
| 2010/0327127 | A1 * | 12/2010 | Crane | 248/68.1 |

* cited by examiner

*Primary Examiner* — Tan Le
(74) *Attorney, Agent, or Firm* — Warn Partners, P.C.

(57) ABSTRACT

A composite appliance base used for manufacture and assembly of various appliances such as a clothes washing machine, clothes dryer, or the like. The composite appliance base includes a heater box, an electric motor mount, a fan shroud, and at least one duct. There are also various inlets which are used for water hoses (in the case where the composite appliance base is used for a washing machine or the like) as well as exhaust ducts and integrated cable clips. In one embodiment, the composite appliance base includes a base portion and a fan shroud, as well as a first duct in fluid communication with the fan shroud. The composite appliance base also includes a second duct which functions as the heater box; the heater box is operable with a heater device to heat air flowing through the heater box, the duct, and the fan shroud.

34 Claims, 15 Drawing Sheets

COMPOSITE APPLIANCE BASE

CROSS-REFERENCE TO RELATED APPLICATIONS

This application claims the benefit of U.S. Provisional Application No. 61/269,370, filed Jun. 24, 2009. The disclosure of the application is incorporated herein by reference.

FIELD OF THE INVENTION

The present invention relates to a composite appliance base used for mounted various components of a clothes washer, clothes dryer, a dishwashing machine, or the like.

BACKGROUND OF THE INVENTION

Household appliances are generally known and used for performing various tasks, such as washing clothes or dishes. Various household appliances include a clothes washer, a clothes dryer, a dishwasher, or the like. Many manufacturers have the ability to construct, design, and build a clothes washer, a clothes dryer, a dishwasher and other household appliances. Many clothes washing machines and dryers are used in the home and are constructed by the same manufacturer, and are sold together. However, because the function of a clothes washing machine is different from that of a clothes dryer (which is also different from that of other appliances, such as a dishwashing machine), various parts and components are used in the assembly of these appliances. Furthermore, there are different types of clothes dryers that operate to dry clothes through the use of electricity, and other types of clothes dryers that operate to dry clothes through the use of natural gas.

However, because each of these appliances performs a different function, each appliance also requires different components, different assembly lines, and different materials. Accordingly, there exists a need for a way to manufacture various household appliances using similar components to reduce cost and assembly time during manufacturing.

SUMMARY OF THE INVENTION

The present invention is a composite appliance base used for manufacture and assembly of various appliances such as a clothes washing machine, clothes dryer, or the like. The composite appliance base includes a heater box, an electric motor mount, a fan shroud, and at least one duct. There are also various inlets which are used for water hoses (in the case where the present invention is used for a washing machine or the like) as well as exhaust ducts and integrated cable clips.

In one embodiment of the present invention, a composite appliance base for use in the construction of appliance includes a base portion, a fan shroud having a removable upper portion and a lower portion, as well as a first duct in fluid communication with the fan shroud. The first duct has a removable upper half integrally formed with the removable upper portion of the fan shroud. The composite appliance base also includes a second duct which functions as the heater box, with the second duct having a lower half, and an upper half removable from the lower half. The heater box is operable with a heater device to heat air flowing through the heater box, the duct, and the fan shroud.

Adjacent the fan shroud is a plurality of motor mounts which are used for supporting an electric motor having a fan disposed in the fan shroud. The fan is used for circulating air heated by the heater box and the duct. There is also a water inlet mounting formed as part of the base portion operable for providing a connection to a source of water in the instance where the composite appliance base is used for a clothes washing machine or a dishwashing machine. Various components of the present invention are all made of a thermoplastic polymer, such as polypropylene including long glass fibers. However it is within the scope of the invention that other materials may be used as well.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Referring to the Figures generally, a composite appliance base according to the present invention is shown generally at 10. The base 10 includes a base portion or floor portion 12. There are various ports, housings, flanges, notches, protrusions, and passages which allow for the composite appliance base 10 to be used in the construction of various home appliances, such as washing machines, dryers, dishwashers, air conditioning units, and the like.

Figure 16:
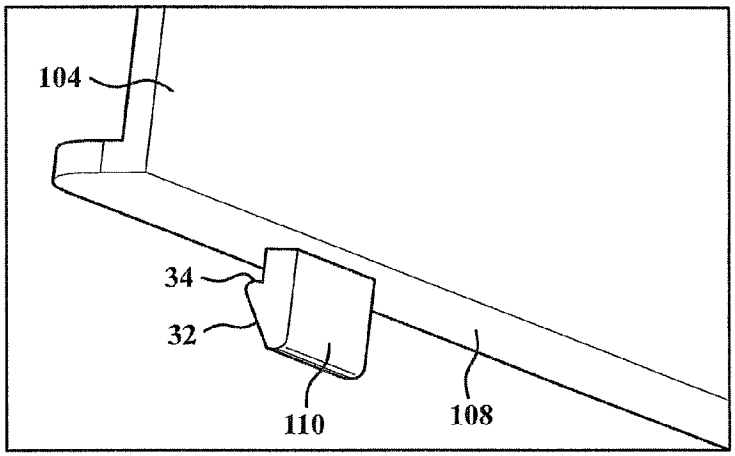
FIG. 16 is an enlarged perspective view of a locking tab used with the removable upper portion of the fan shroud and removable upper half of the duct shown in FIG. 15A, and the upper half of the heater box shown in FIG. 15B.
Figure 14:
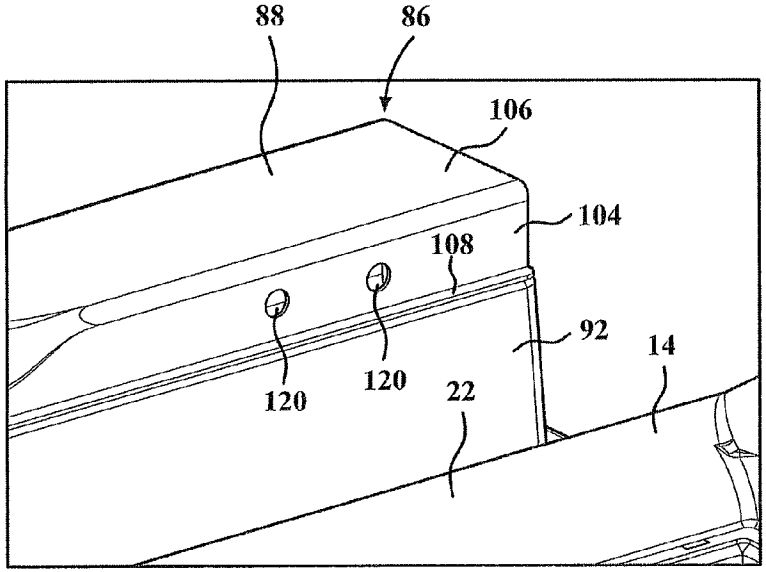
FIG. 14 is an enlarged perspective view of a heater box formed as part of a composite appliance base, according to the present invention.
Figure 15B:
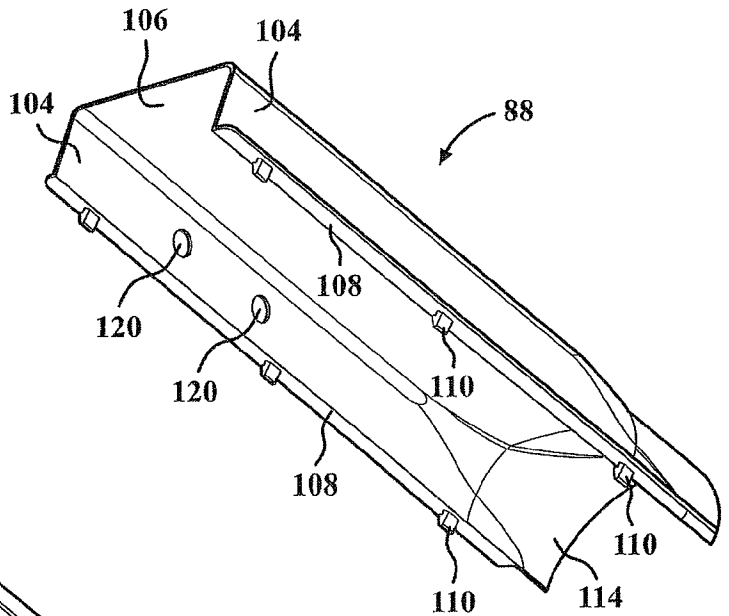
FIG. 15B is an enlarged perspective view of the upper half of a heater box used as part of a composite appliance base, according to the present invention.
Figure 15A:
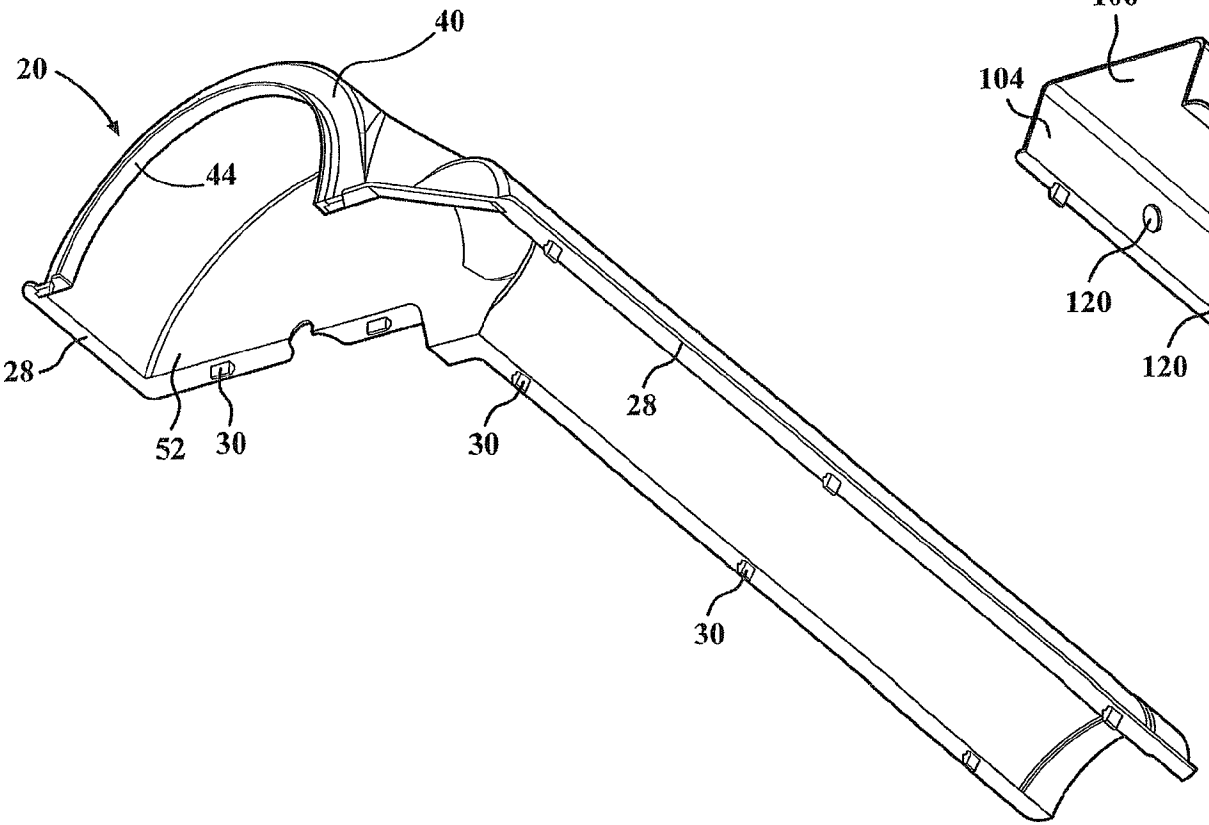
FIG. 15A is an enlarged perspective view of a removable upper portion of a fan shroud and a removable upper half of a duct integrated as a single component and used in a composite appliance base, according to the present invention.
Figure 17:
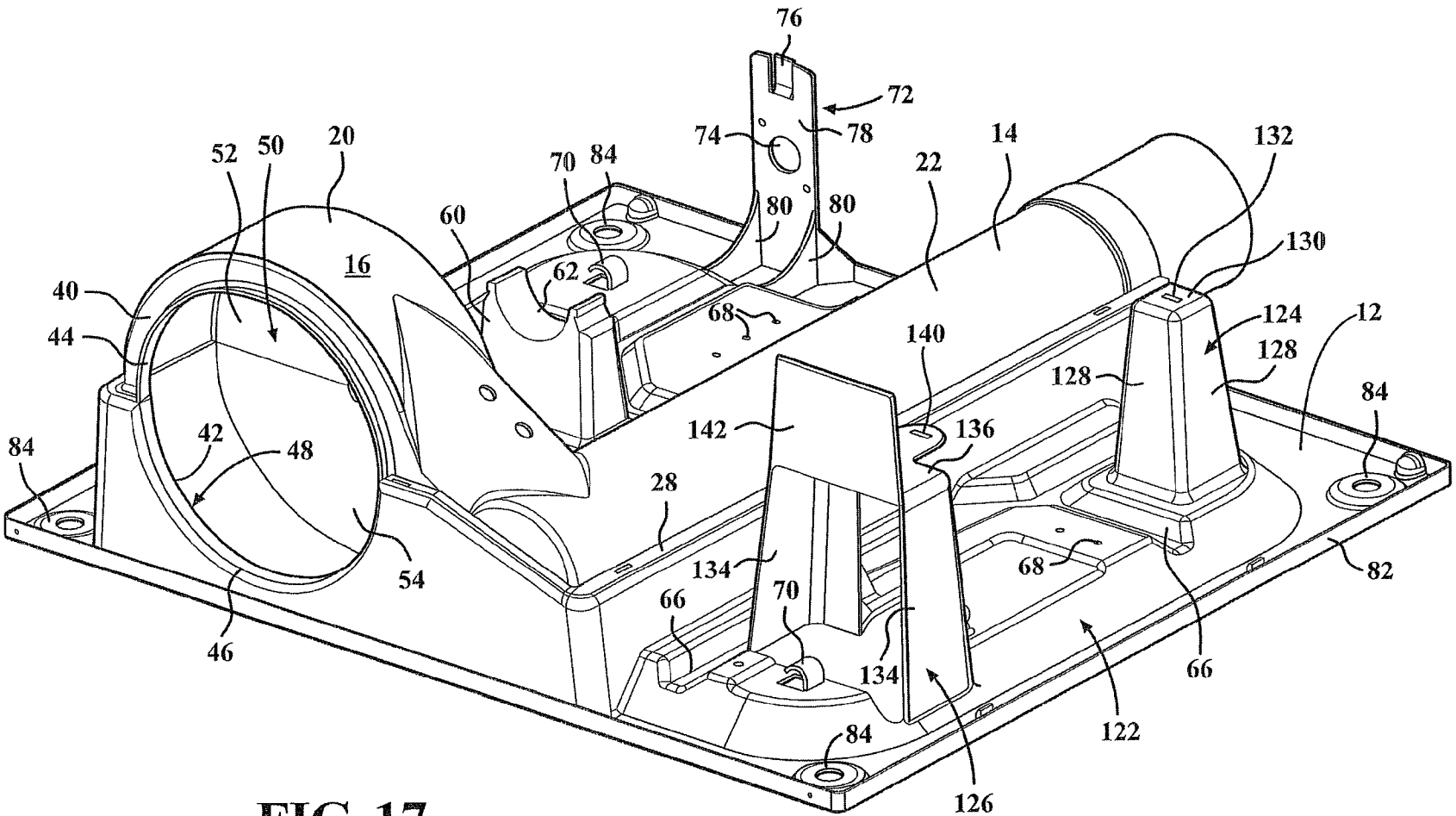
FIG. 17 is a perspective view of a composite appliance base with the upper half and lower half of the heater box removed, according to the present invention.
Figure 18:
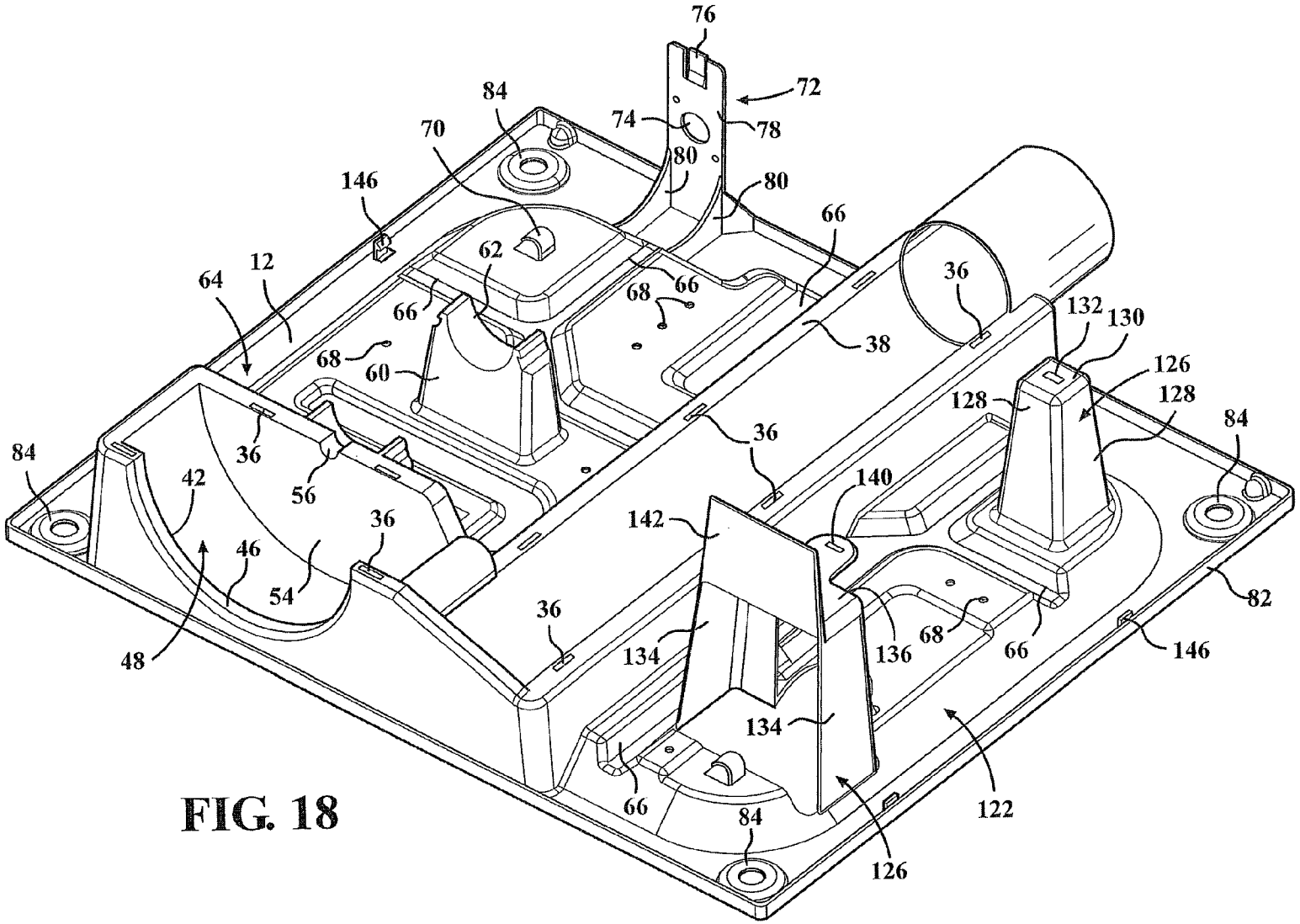
FIG. 18 is a perspective view of a composite appliance base with the upper half and lower half of the heater box removed as well as the removable upper portion of the fan shroud and the removable upper half of the duct removed, according to the present invention.
Figure 19:
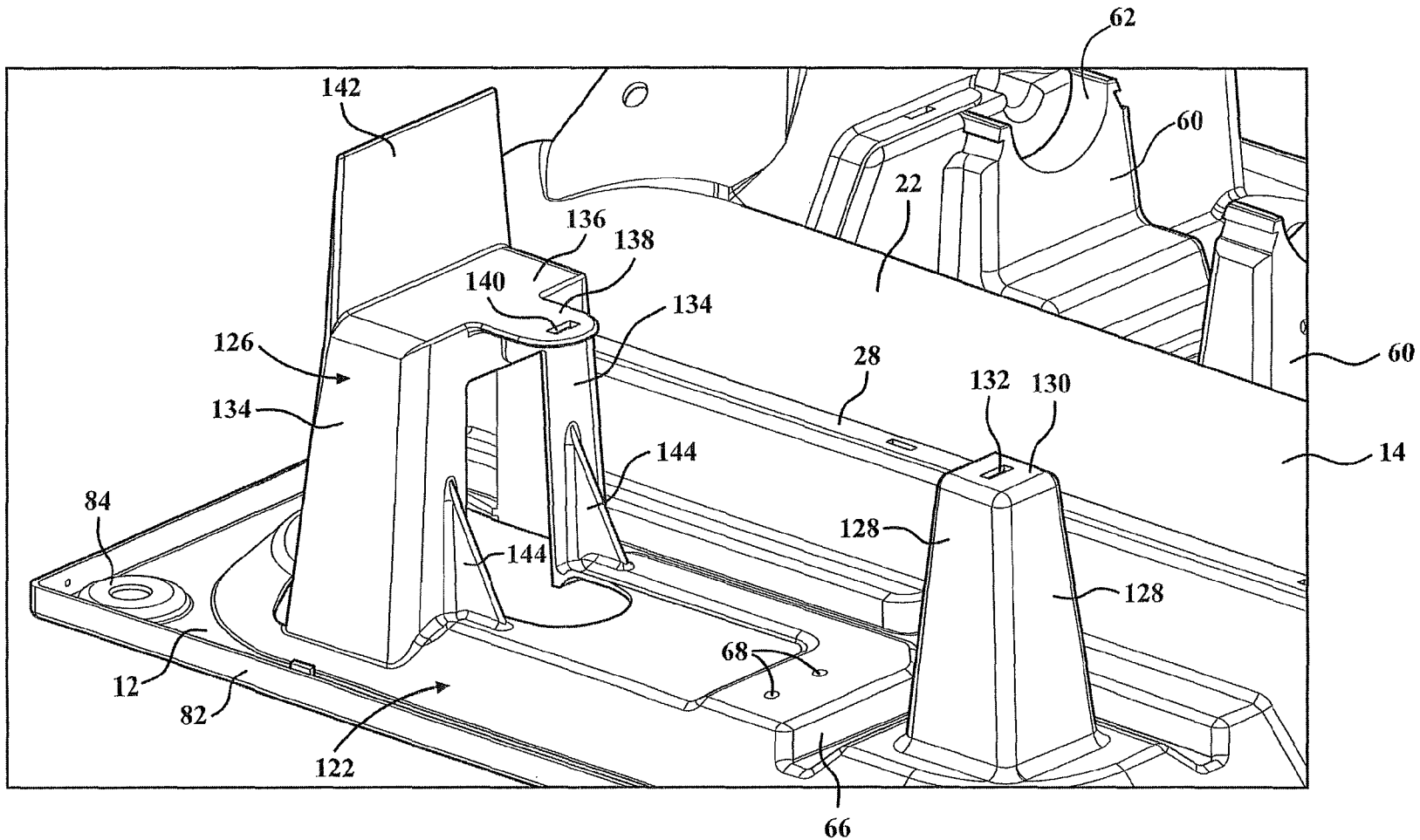
FIG. 19 is an enlarged perspective view of a composite appliance base with the upper half and the lower half of the heating box removed, according to the present invention.
Figure 20:
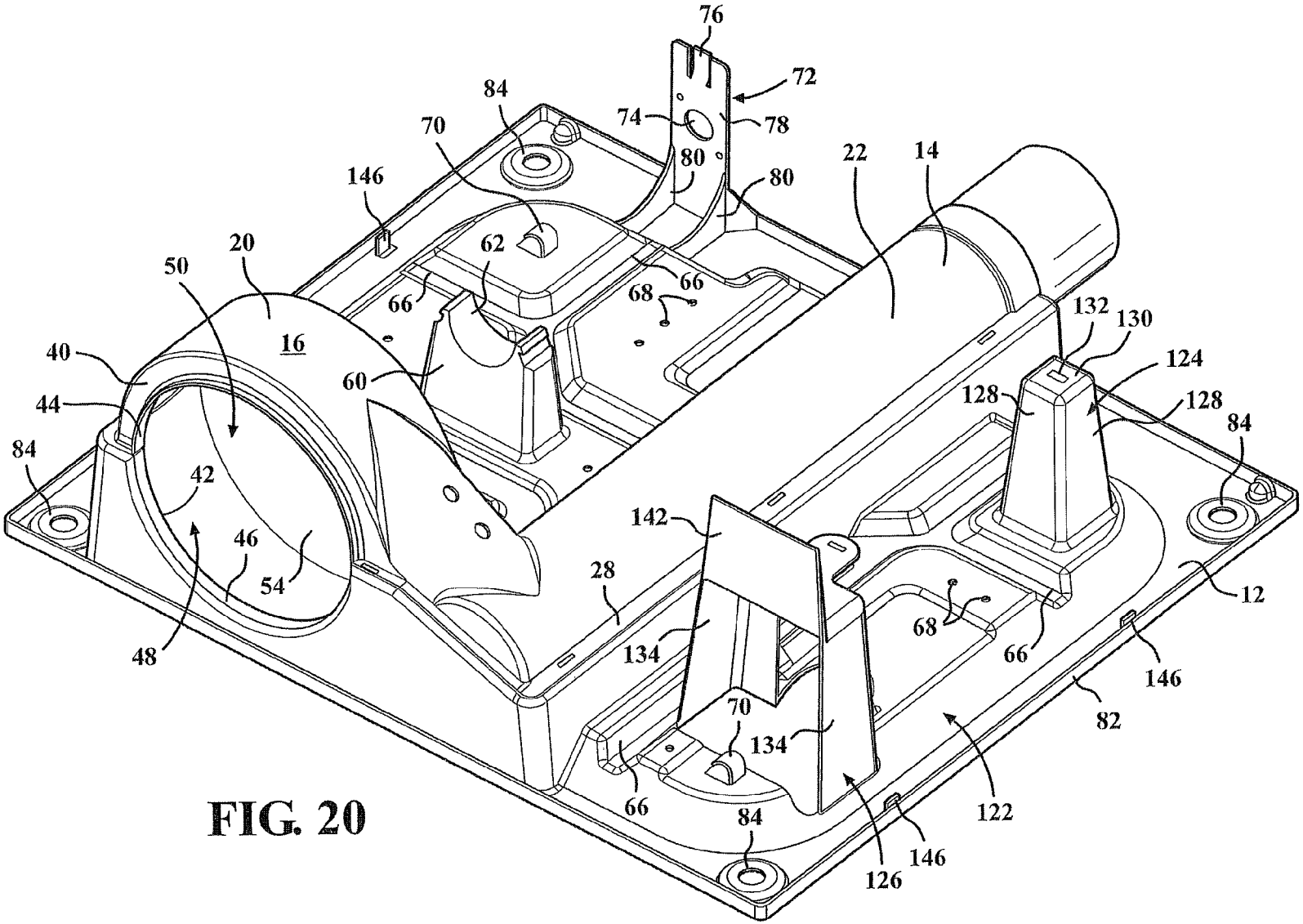
FIG. 20 is another perspective view of a composite appliance base with the upper half and the lower half of the heater box removed, according to the present invention.

More particularly, the composite appliance base 10 includes at least one duct 14 in fluid communication with a fan shroud, generally shown at 18, having an outer surface 16. The fan shroud 18 and duct 14 are substantially integrated together as a single component. The fan shroud 18 has a removable upper portion 20 formed with a removable upper half 22 of the duct 14. The upper portion 20 of the fan shroud 18 is connectable to a lower portion, generally shown at 24, and the upper half 22 of the duct 14 is connectable to a lower half, generally shown at 26. Substantially surrounding the outer periphery of the upper portion 20 and the upper half 22 is a flange portion 28 having a plurality of locking tabs 30, best seen in FIG. 15A. The locking tabs 30 are similar to locking tabs 110 shown in FIGS. 15B and 16, and have similar elements. The locking tabs 30 have a deflection surface 32 and a retention surface 34; each the locking tabs 30 is operable to be received into a respective aperture, which in this in embodiment is a substantially rectangular-shaped aperture 36 formed along a ledge portion 38 of the lower half 26 of the duct 14.

To connect the upper half 22 of the duct 14 to the lower half 26 of the duct 14, and the upper portion 20 of the fan shroud 18 to the lower portion 24 of the fan shroud 18, each locking tab 30 is inserted into a respective aperture 36. As each locking tab 30 is inserted into a respective aperture 36, one of the surfaces 39 of the aperture 36 contacts the deflection surface 32, causing the locking tab 30 to deflect. The locking tab 30 continues to deflect further until the locking tab 30 is pressed in far enough such that the deflection surface 32 has moved through the aperture 36 completely; this allows the locking tab 30 to move back to its original position, the retention surface 34 is then positioned underneath the ledge portion 38. The distance between the retention surface 34 and the flange portion 28 approximates the thickness of the ledge portion 38 so as to provide a desired fit.

The upper portion 20 of the fan shroud 18 also includes an upper lip portion 40 adjacent the outer surface 16 which works in conjunction with a lower lip portion 42 formed as part of the lower portion 24 of the fan shroud 18 to surround a fan (not shown) operable for being disposed in the fan shroud 18. Formed as part of the upper lip portion 40 and substantially perpendicular to the upper lip portion 40 is a lip projection 44, the lip projection 44 is adjacent a corresponding rim portion 46 formed as part of the lower lip portion 42. The lip projection 44 and the rim portion 46 form an aperture, shown generally at 48. The aperture 48 allows air to pass through into the fan shroud 18 in the application where the composite appliance base 10 is used in the construction of a dryer; however, it is within the scope of the invention that air passing through the aperture 48 may be used for other applications as well.

The fan shroud 18 also includes a rear wall, shown generally at 50, having an upper wall portion 52 formed as part of the upper portion 20 of the fan shroud 18, and a lower wall portion 54 formed as part of the lower portion 24 of the fan shroud 18. Each of the wall portions 52,54 includes a semi-circular notch 56, which when assembled forms a small aperture, generally shown at 58, such that a shaft for a motor (not shown) is operable for extending through the small aperture 58 to connect to a fan located within and surrounded by the fan shroud 18.

Located in proximity to the fan shroud 18 is a pair of motor mounts 60 which are capable of supporting an electric motor, compressor, a pump, or any other type of device as necessary for the proper functioning of the appliance for which the composite appliance base 10 is being used. While the motor mounts 60 are each shown as having a pair of semi-circular recesses 62, it is within the scope of the invention that the recesses 62 may be replaced with other components suitable for supporting an electric motor or the like, such as, but not limited to, a flat surface.

The motor mounts 60 are formed as part of a raised platform, generally shown at 64. The raised platform 64 includes several channels 66, small apertures 68 operable for receiving various fasteners (such as bolts, screws, or the like), as well as a plurality of integrated cable clips 70, which are used for securing various wiring components in place when the appliance is assembled.

Adjacent the raised platform 64 is a water inlet mounting, shown generally at 72, and a hose for delivering water may extend through and be connected to a device such as a water pump, if the composite appliance base 10 is used for an appliance which requires water for operation, such as a washing machine or dishwasher. The water inlet mounting 72 includes an aperture 74 operable for providing a connection with a hose (not shown) for delivering water to the appliance the base 10 is being used with. There is also an offset flange 76 formed as part of a main flange 78; the flanges 76,78 may function as a valve attachment, and are used for supporting a valve for controlling the delivery of water from the hose connected to the water inlet mounting 72. Adjacent and connected to the water inlet mounting 72 is a pair of supports 80, which are curved as shown in the Figures, and are operable for supporting the water inlet mounting 72. The main flange 78 of the water inlet mounting 72 is offset from an outer lip 82 which substantially surrounds the base portion 12.

Also formed as part of the base portion 12 is a plurality of molded feet housings 84 which are used for receiving various supports, or "feet," used for supporting the appliance the composite appliance base 10 is assembled to. The feet may be adjusted to different heights to compensate for different slopes in the surface where the appliance is located. The feet are located in the molded feet housings 84 so as to conceal the feet from view.

Figure 1:
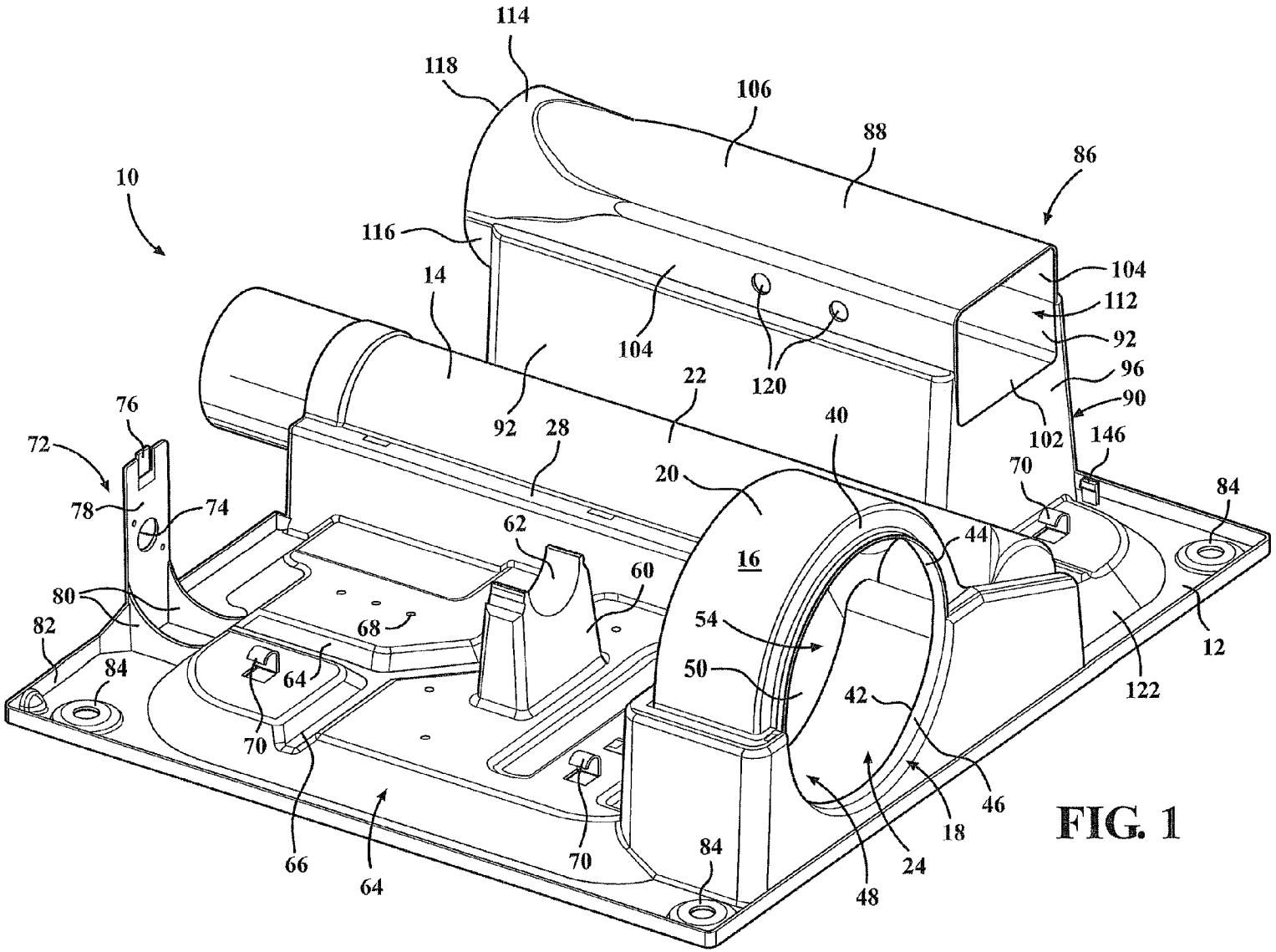
FIG. 1 is a perspective view of a composite appliance base, according to the present invention.
Figure 2:
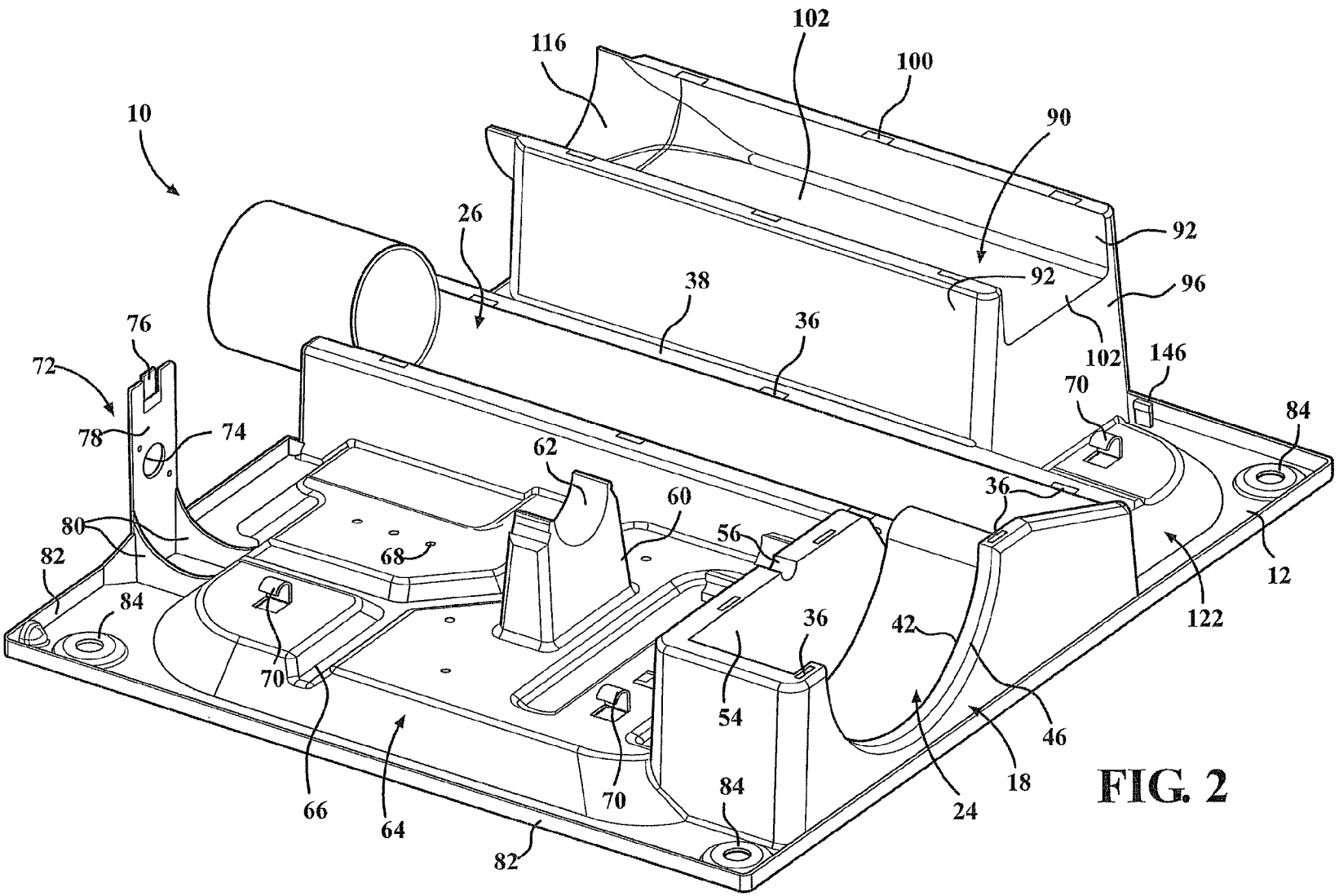
FIG. 2 is a perspective view of a composite appliance base with the upper half of the heater box as well as the removable upper portion of the fan shroud and removable upper half of the first duct removed, according to the present invention.
Figure 3:
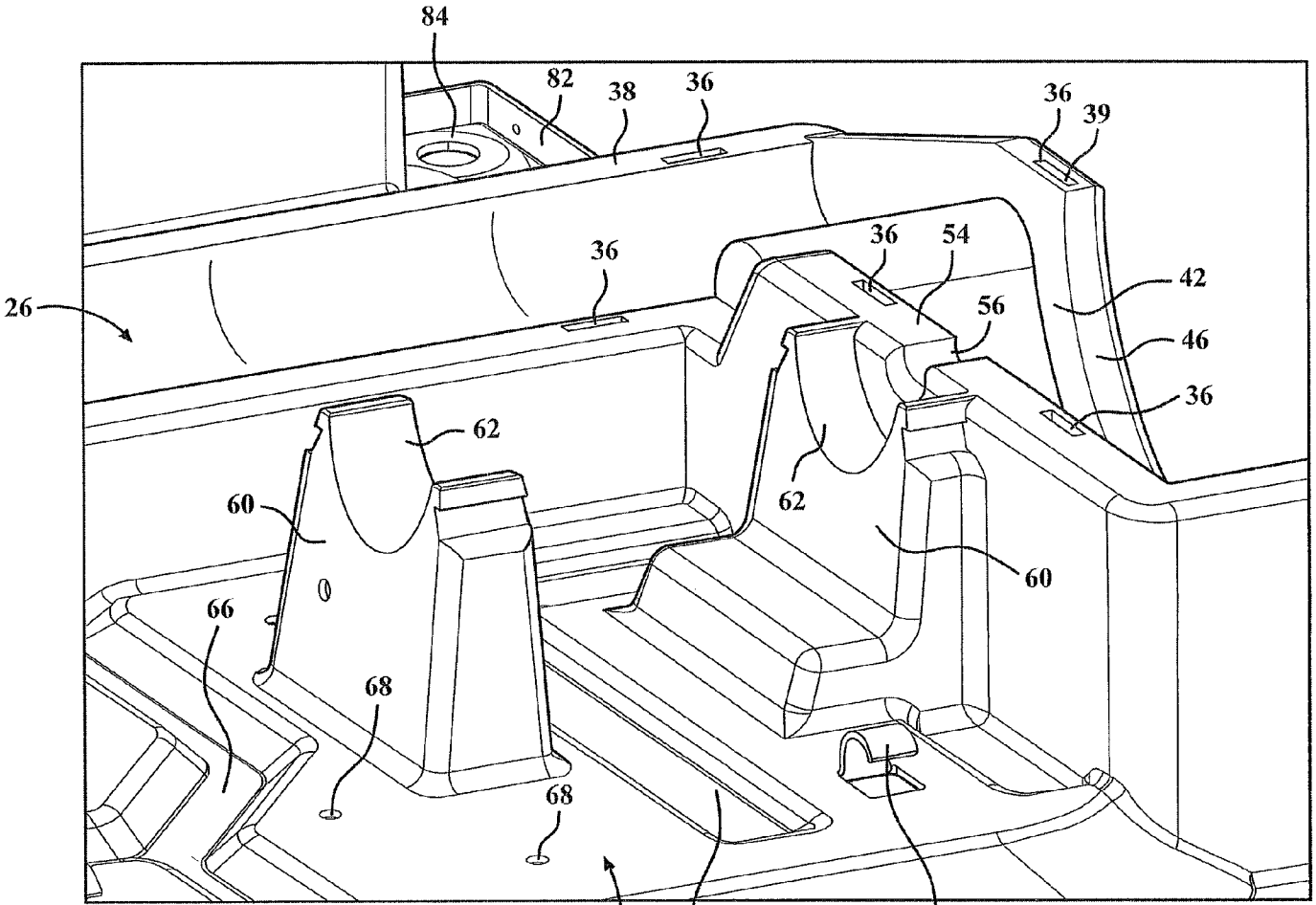
FIG. 3 is an enlarged perspective view of a set of electric motor mounts which are formed as part of a composite appliance base, according to the present invention.
Figure 4:
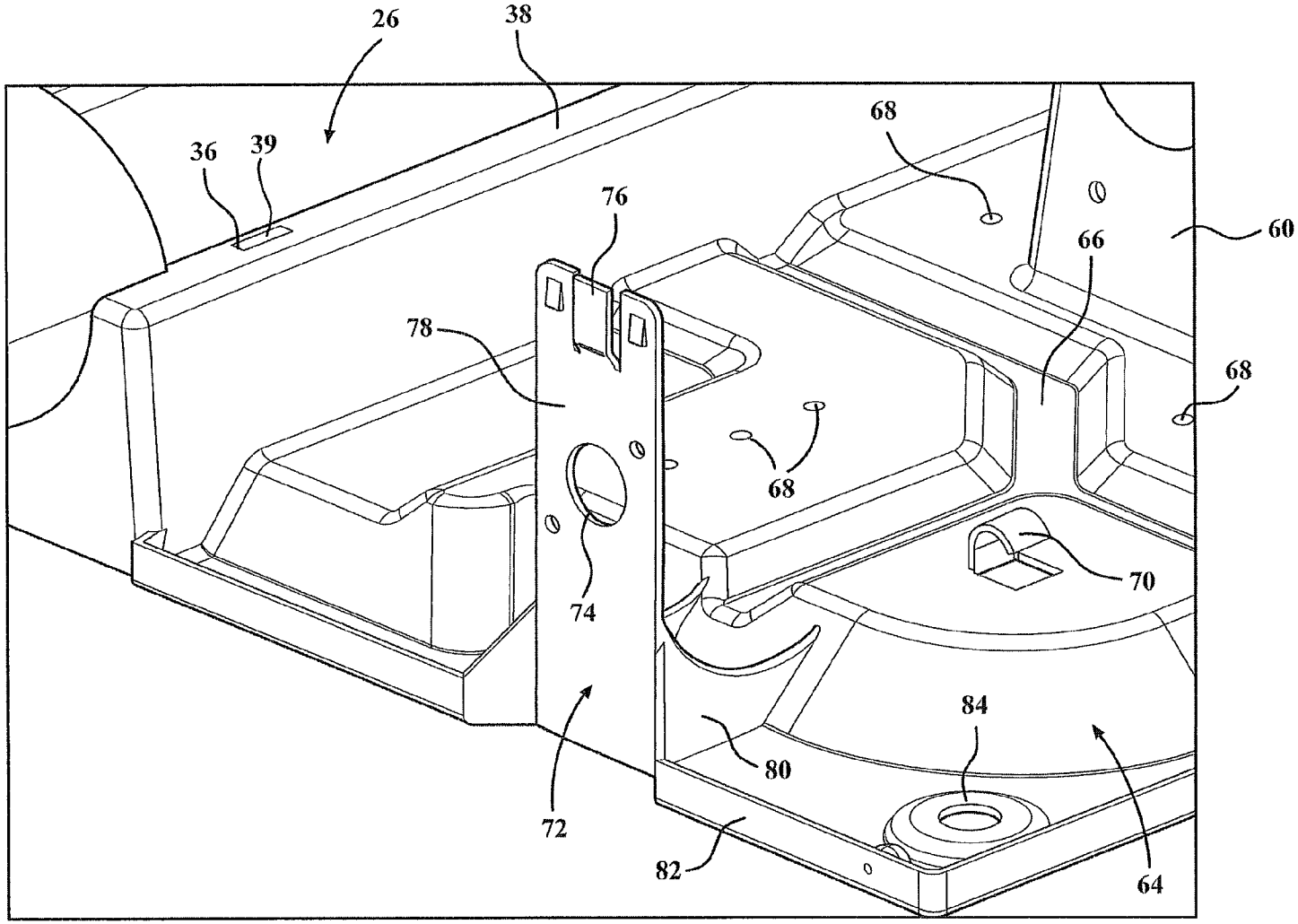
FIG. 4 is a first enlarged perspective view of a water inlet mounting used with a composite appliance base, according to the present invention.
Figure 5:
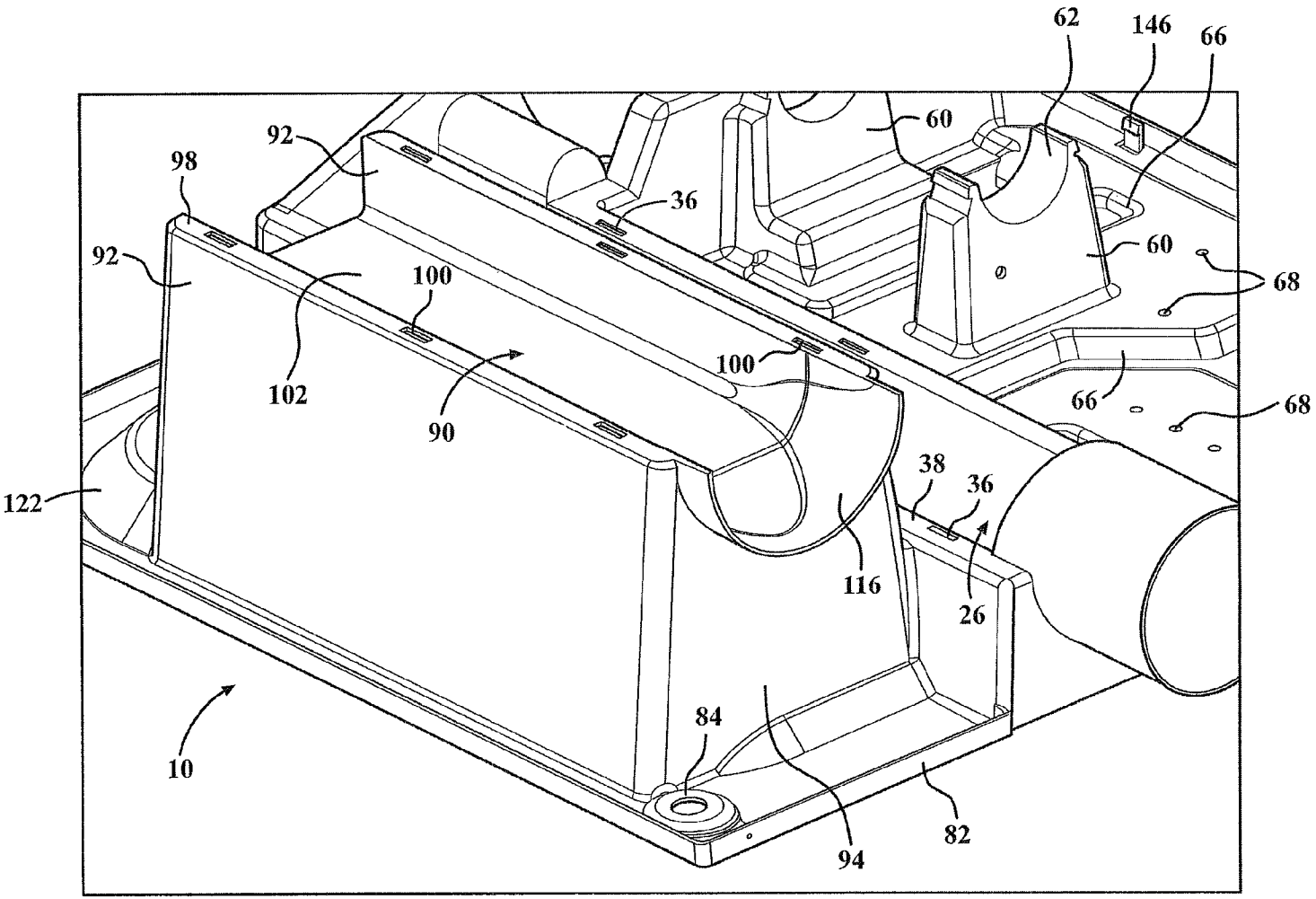
FIG. 5 is an enlarged perspective view of a heater box used in an appliance base with the upper half of the heater box removed, according to the present invention.
Figure 6:
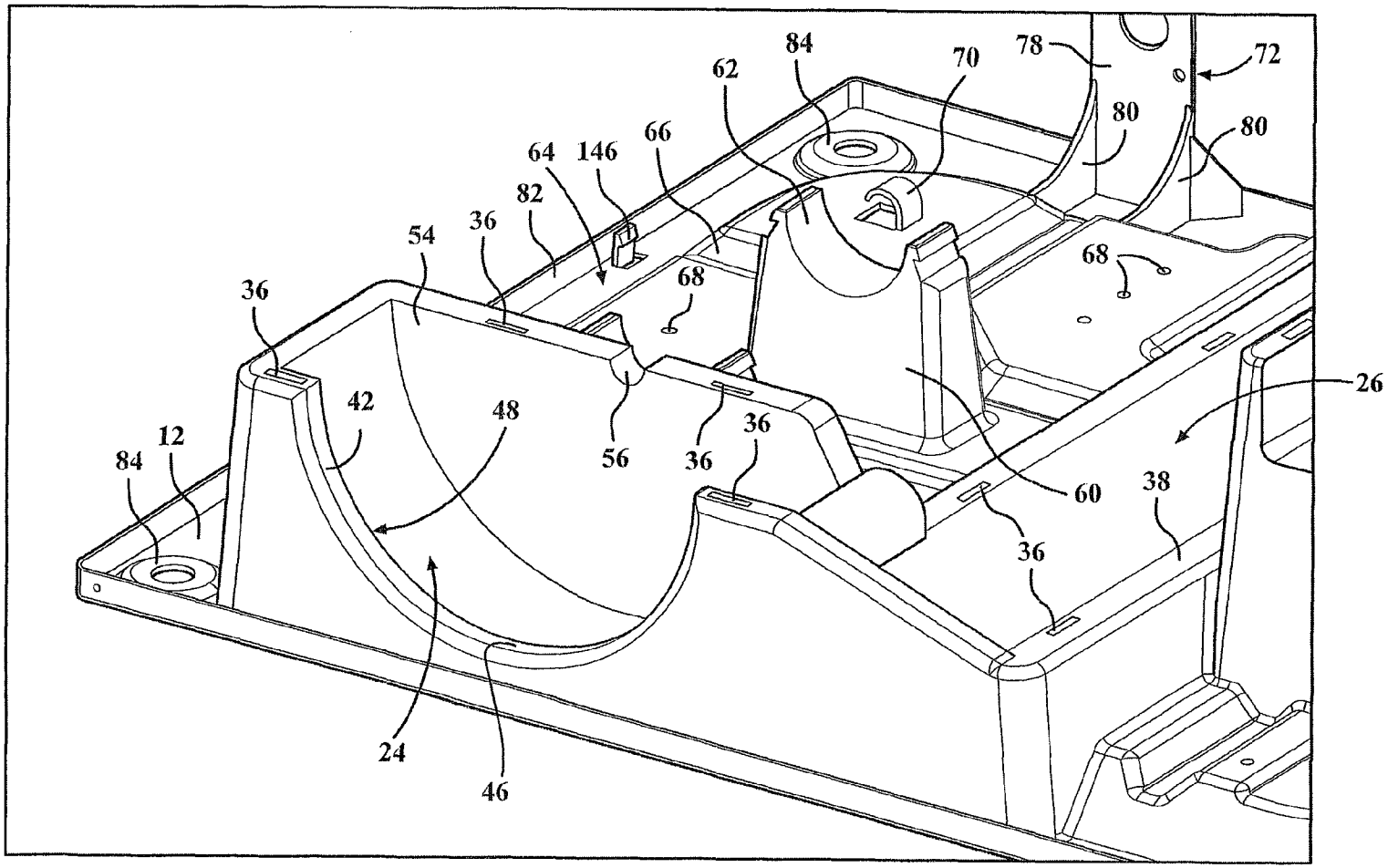
FIG. 6 is a second perspective view of a composite appliance base with the upper half of the heater box as well as the removable upper portion of the fan shroud and removable upper half of the first duct removed, according to the present invention.
Figure 7:
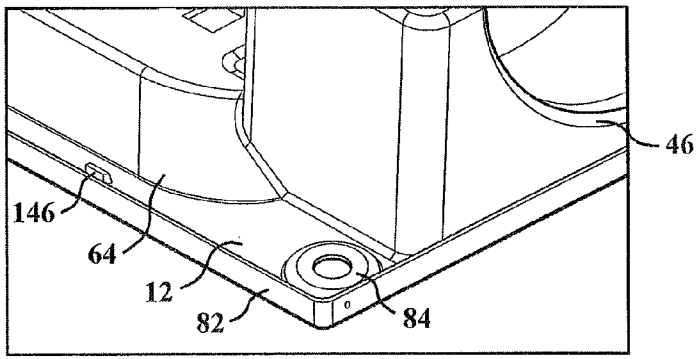
FIG. 7 is an enlarged perspective view of a molded foot housing formed as part of the base portion of a composite appliance base, according to the present invention.
Figure 9:
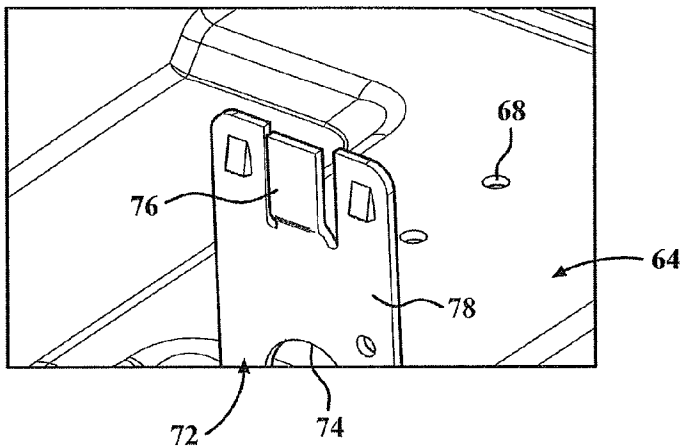
FIG. 9 is a second enlarged perspective view of a water inlet mounting used for a composite appliance base, according to the present invention.
Figure 8:
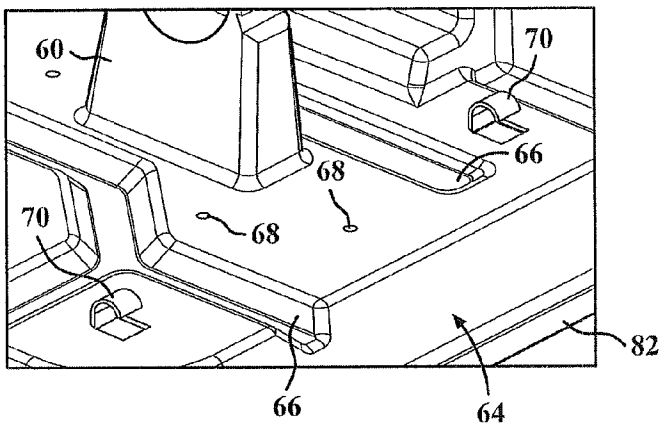
FIG. 8 is an enlarged view showing integrated cable clips formed as part of a raised platform of a base portion which is part of a composite appliance base, according to the present invention.
Figure 10:
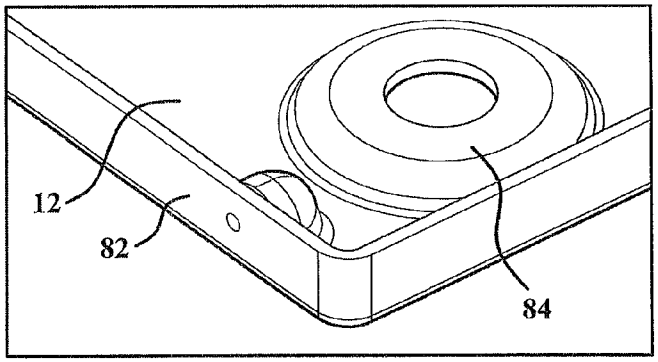
FIG. 10 is a second enlarged perspective view of a molded foot housing formed as part of a base portion, used in a composite appliance base, according to the present invention.
Figure 12:
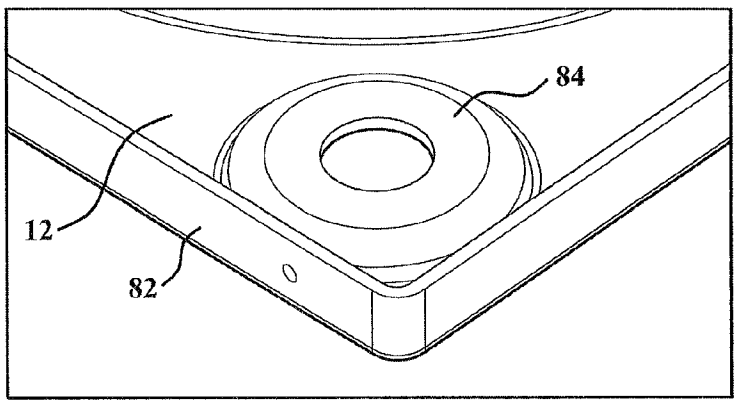
FIG. 12 is a third enlarged perspective view of a molded foot housing formed as part of a base portion, used with a composite appliance base, according to the present invention.

Referring again to the Figures generally, also integrally formed as part of the composite appliance base 10 is a heater box, shown generally at 86. The heater box 86 includes an upper half 88 and a lower half, shown generally at 90. The upper half 88 is detachable from the lower half, generally shown at 90, and is shown detached in FIGS. 2, 5, and 15B. The lower half 90 may be either integrally formed with the base portion 12, or formed as a separate component and attached to the base portion 12.

The lower half 90 has side wall portions 92, a rear wall portion 94, and a front wall portion 96. The side wall portions 92 terminate into a ledge 98 having rectangular-shaped apertures 100 similar to the rectangular-shaped apertures 36 formed as part of the outer surface 38. Disposed between the side wall portions 92 is a support surface 102.

The upper half 88 includes a pair of side wall portions 104 which are each connected to a top wall portion 106. Also connected to each of the side wall portions 104 is an outwardly extending flange 108, and the outwardly extending flange 108 has a plurality of locking tabs 110 which, as mentioned above, are similar to the locking tabs 30 formed on the flange portion 28 shown in FIG. 15A. The locking tabs 110 are operable for being inserted into the rectangular-shaped apertures 100 (functioning in a similar manner to the locking tabs 30 and rectangular-shaped apertures 36) to maintain the attachment of the upper half 88 of the heater box 86 attached to the lower half 90.

The side wall portions 104 and top wall portion 106 of the upper half 88 along with the side wall portions 92 and the support surface 102 form a substantially square-shaped aperture or duct, generally shown at 112. If the composite appliance base 10 is being used in an application relating to a dryer, an electronic heating element functions to heat air forced through the duct 112 by the fan located in the fan shroud 18. The duct 14 is in fluid communication with the duct 122 trough separate ducts or passages (not shown) which further facilitate airflow when the composite appliance base 10 is used in the construction of a dryer.

The side wall portions 104 and top wall portion 106 of the upper half 88 also terminate into an upper semi-circular flange 114. Similarly, the support surface 102 and inner surfaces of the side wall portions 92 adjacent the support surface 102 terminate into a lower semi-circular flange 116. When the upper half 88 of the heater box 86 is attached to the lower half 90, the upper semi-circular flange 114 and lower semi-circular flange 116 form a circular aperture 118 in fluid communication with the duct 112. The aperture 118 is operable for being connected to an intake duct or the like for allowing air to pass through the duct 112. One of the side wall portions 104 formed as part of the upper half 88 also includes overflow apertures 120 which may be used for preventing too much pressure from building in the heater box 86.

As mentioned above, the lower half 90 of the heater box 86 may be formed as a separate component relative to the base portion 12. Referring to FIGS. 16-19, the composite appliance base 10 is shown with the lower half 90 of the heater box 86 having been removed. The area of the base portion 12 substantially underneath the lower half 90 of the heater box 86 includes a second raised platform, generally shown at 122, which also includes small apertures 68 and channels 66 similar to the raised platform 64.

The second raised platform 122 also includes a first support member, generally shown at 124, and a second support member, generally shown at 126. The first support member 124 protrudes substantially vertically from the second raised platform 122, and includes several wall sections 128 which are tapered from top to bottom such that the area of the first support member 124 is larger toward the bottom of the first support member 124 as compared to the top of the first support member 124. The wall sections 128 are connected to a top support surface 130 having a rectangular-shaped aperture 132, which is similar to the rectangular-shaped apertures 36,100 mentioned above.

The second support member 126 includes two L-shaped wall portions 134 connected to a second top support surface 136 having a tab portion 138 with another rectangular-shaped aperture 140. Also connected to the second top surface 136 is a backing plate 142. Each of the L-shaped wall portions 134 includes a buttress 144 for providing additional support to each of the L-shaped wall portions 134.

The top support surfaces 130,136 are operable for supporting the electronic heating element, as mentioned above, which may be attached to the support members through the use of fasteners extending into the apertures 132,140.

Figure 11:
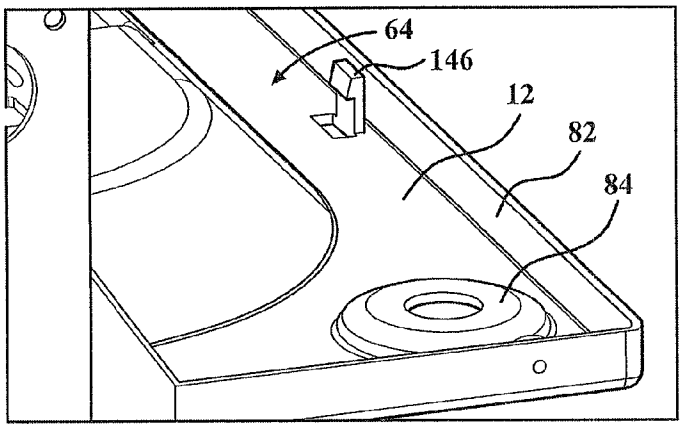
FIG. 11 is an enlarged perspective view of a snap clip and a molded foot housing formed as part of a base portion, used in a composite appliance base, according to the present invention.
Figure 13:
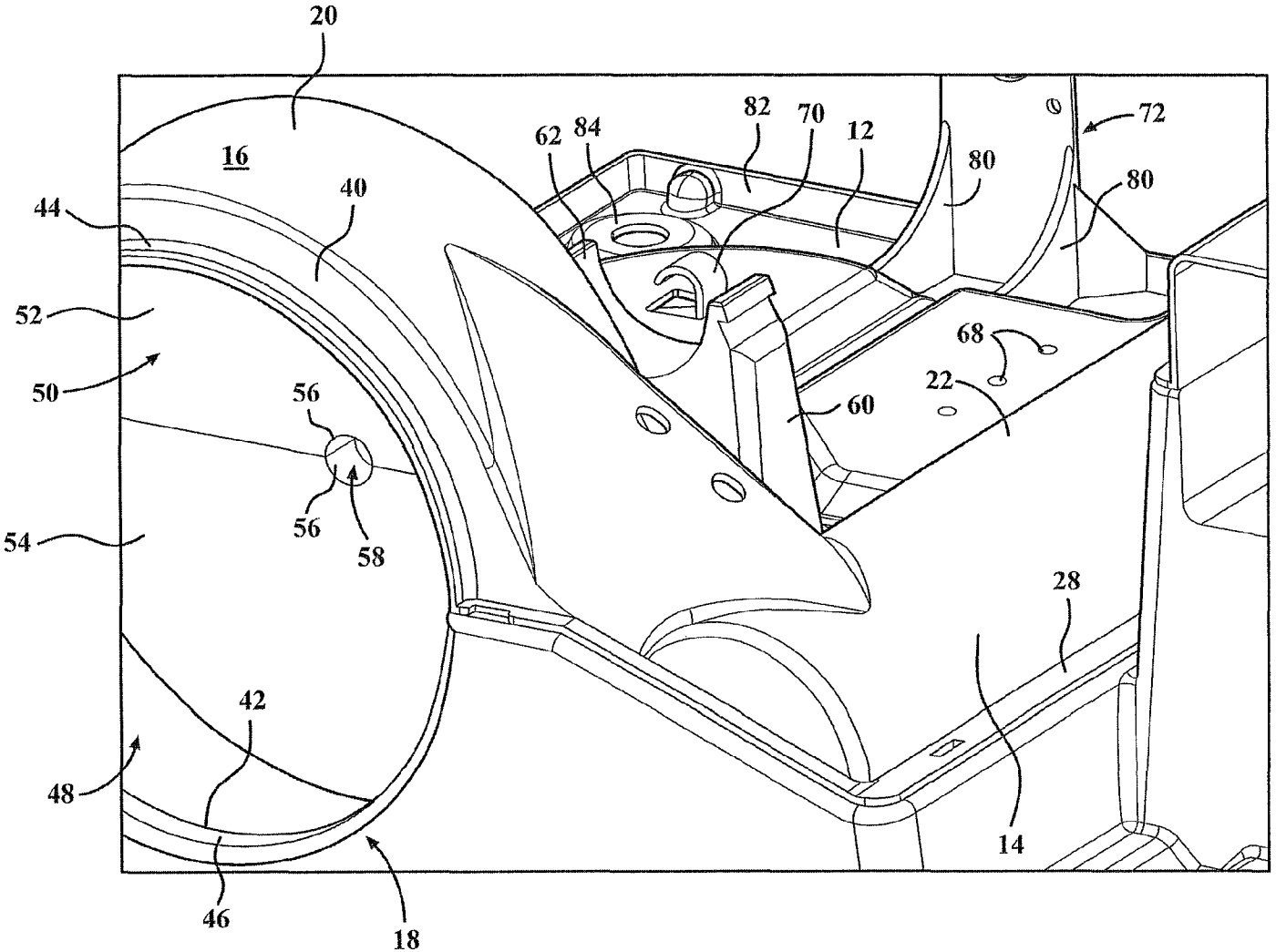
FIG. 13 is an enlarged perspective view of a fan shroud and first duct which are part of a composite appliance base, according to the present invention.

Also formed as part of the base portion 12 is a plurality of snap clips 146, best seen in FIG. 11. The snap clips 146 provide for a simple connecting to a body panel or frame of an appliance used with the composite appliance base 10 of the present invention. The features described above allow the composite appliance base 10 of the present invention to be used in the construction of any appliance, such as a clothes washing machine, clothes dryer, dishwasher, or the like.

In one embodiment, the base portion 12 as well as the removable upper portion 20 of the fan shroud 18, the removable upper half 22 of the duct 14, and the upper half 88 of the heater box 86 are all made of a thermoplastic polymer, such as polypropylene (PP). Alternatively, other types of thermoplastic polymers may be used which incorporate long glass fibers, such as long glass fiber PP or long glass fiber sheet molding compound (SMC).

in an alternate embodiment, if the composite appliance base 10 of the present invention is to be used with a dryer which operates using natural gas, then the upper half 88 of the heater box 86 may be made of metal, such as aluminum or steel, to withstand the temperatures of the gas.

The present invention is a composite appliance base 10 which is used in the construction of an appliance, such as a clothes washing machine, clothes dryer, dishwashing machine, or the like. The ducts 14,112 are operable for facilitating airflow through the appliance, and the airflow may be controlled by a fan disposed in the fan shroud 18, and connected to an electric motor mounted to the motor mounts 60. The water inlet mounting 72 provides for a suitable connection to a water supply the composite appliance base 10 is used in the construction of a clothes washing machine, a dishwashing machine, or any other appliance requiring water for operation.

The description of the invention is merely exemplary in nature and, thus, variations that, do not depart from the essence of the invention are intended to be within the scope of the invention. Such variations are not to be regarded as a departure from the spirit and scope of the invention.

What is claimed is:

1. A composite appliance base, comprising:
a base portion;
a fan shroud mounted to said base portion;
a first duct in fluid communication with said fan shroud;
a second duct, at least a portion of said second duct integrally formed as part of said base portion in proximity to said first duct such that said second duct is operable for being placed in fluid communication with said first duct such that air flowing through said second duct is heated prior to passing through said fan shroud and said first duct; and
a plurality of cable clips formed as part of said base portion operable for providing proper positioning of cables used with said composite appliance base.

2. The composite appliance base of claim 1, said first duct further comprising:
a removable upper half; and
a lower half integrally formed with said base portion, said removable upper half selectively connectable to said lower half of said first duct to facilitate fluid communication between said first duct and said fan shroud.

3. The composite appliance base of claim 1, said fan shroud further comprising:
a removable upper portion; and
a lower portion integrally formed with said base portion such that said removable upper portion is selectively connectable to said lower portion and facilitate fluid communication between said fan shroud and said first duct.

4. The composite appliance base of claim 3, said fan shroud further comprising:
an upper wall formed as part of said removable upper portion; and
a lower wall formed as part of said lower portion and in contact with said upper wall formed as part of said removable upper portion when said removable upper portion is connected to said lower portion, forming said fan shroud.

5. The composite appliance base of claim 4, said fan shroud further comprising:
a semi-circular notch formed as part of said upper wall; and
a semi-circular notch formed as part of said lower wall such that when said removable upper portion is connected to said lower portion, said semi-circular notch formed as part of said upper wall and said semi-circular notch formed as part of said lower wall form an aperture.

6. The composite appliance base of claim 1, wherein said second duct is a heater box, further comprising:
a lower half operable for being selectively connected to said base portion;
an upper half operable for being selectively connected to said lower half such that said second duct is formed.

7. The composite appliance base of claim 6, further comprising at least one support member integrally formed as part of said base portion operable for supporting a heating element for heating air passing through said second duct, said at least one support member substantially surrounded by said lower half of said second duct.

8. The composite appliance base of claim 7, said at least one support member further comprising:
a first support member integrally formed as part of said base portion; and
a second support member integrally formed as part of said base portion such that said first support member and said second support member are covered by said lower half of said second duct when said lower half of said second duct is assembled to said base portion.

9. The composite appliance base of claim 8, further comprising:
a first top support surface formed as part of said first support member;
a second top support surface formed as part of said second support member; and
a backing plate formed as part of said second support member substantially perpendicular to said second top support surface such that said first top support surface, said second top support surface, and said backing plate are operable to support said heating element operable for heating air passing through said second duct.

10. The composite appliance base of claim 1, further comprising at least one motor mount formed as part of said composite appliance base in proximity to said fan shroud.

11. The composite appliance base of claim 10, further comprising at least one semi-circular recess formed as part of said at least one motor mount operable for supporting an electric motor connected to a fan located in said fan shroud.

12. The composite appliance base of claim 1, further comprising a water inlet mount connected to said base portion, said water inlet mount operable for connection with a source of water.

13. The composite appliance base of claim 12, said water inlet mount further comprising:
a main flange integrally formed as part of said base portion; and
an aperture formed as part of said main flange, wherein a conduit in fluid communication with said source of water is mounted in said aperture and operable for providing a source of water to said composite appliance base.

14. The composite appliance base of claim 13, said water inlet mount further comprising an offset flange formed as part of said main flange operable for supporting a valve to control the amount of flow through said conduit.

15. A composite appliance base for use in the construction of an appliance, comprising:
a base portion;
a first duct formed as part of said base portion;
a fan shroud integrally formed as part of said base portion such that said fan shroud is in fluid communication with said first duct;
a second duct formed as part of said base portion in proximity to said first duct, said second duct operable for being placed in fluid communication with said first duct;
at least one support member operable for supporting a heating element such that said heating element is operable to increase the temperature of air flowing through said second duct; and
a plurality of cable clips integrally formed as part of said base portion operable for retaining cables in a desired position.

16. The composite appliance base for use in the construction of an appliance of claim 15, said fan shroud further comprising:
a removable upper portion having an upper wall; and
a lower portion formed as part of said base portion, said lower portion having a lower wall, said upper wall and said lower wall forming a rear wall of said fan shroud when said removable upper portion is connected to said lower portion.

17. The composite appliance base for use in the construction of an appliance of claim 16, said fan shroud further comprising:

a semi-circular notch formed as part of said upper wall of said removable upper portion; and a semi-circular notch formed as part of said lower wall of said lower portion, said semi-circular notch formed as part of said upper wall and said semi-circular notch formed as part of said lower wall form an aperture when said removable upper portion is connected to said lower portion.

18. The composite appliance base for use in the construction of an appliance of claim 15, said first duct further comprising:

a removable upper half integrally formed as part of said removable upper portion of said fan shroud; and a lower half integrally formed as part of said base portion such that said lower half of said first duct is also integrally formed with said lower portion of said fan shroud, and when said removable upper half of said first duct is connected to said lower half of said duct and said removable upper portion of said fan shroud is connected to said lower portion of said fan shroud, air is allowed to pass between said fan shroud and said first duct.

19. The composite appliance base for use in the construction of an appliance of claim 15, said second duct further comprising:

a lower half selectively connected to said base portion in proximity to said first duct; and an upper half selectively connected to said lower half to form an aperture such that said second duct is operable to be placed in fluid communication with said first duct to provide circulation of air between said first duct, said second duct, and said fan shroud.

20. The composite appliance base for use in the construction of an appliance of claim 19, said at least one support member further comprising:

a first support member integrally formed with said base portion in proximity to said first duct; and a second support member integrally formed with said base portion in proximity to said first duct and said first support member, wherein said first support member and said second support member are concealed by said lower half of said second duct when said second duct is connected to said base portion.

21. The composite appliance base for use in the construction of an appliance of claim 20, further comprising a first top support surface formed as part of said first support member;

a second top support surface formed as part of said second support member; and a backing plate formed as part of said second support member substantially perpendicular to said second top support surface such that said first top support surface, said second top support surface, and said backing plate are operable to support said heating element operable for heating air passing through said second duct.

22. The composite appliance base for use in the construction of an appliance of claim 15, further comprising a water inlet mounting formed as part of said base portion operable for supporting a valve and a conduit in fluid communication with a water source.

23. The composite appliance base for use in the construction of an appliance of claim 22, said water inlet mounting further comprising:

a main flange;

an aperture formed as part of said main flange such that a hose in fluid communication with a water supply is operable for being mounted to said aperture formed as part of said main flange; and an offset flange formed as part of said main flange, wherein a valve is operable for being mounted to said offset flange formed as part of said main flange for controlling the flow of fluid through said hose mounted within said aperture.

24. The composite appliance base for use in the construction of an appliance of claim 15, further comprising a plurality of motor mounts integrally formed as part of said base portion, at least one of said plurality of motor mounts formed as part of said base portion in proximity to said fan shroud.

25. The composite appliance base for use in the construction of an appliance of claim 24, each of said plurality of motor mounts further comprising a semi-circular recess operable for supporting an electric motor mounted to said plurality of motor mounts.

26. A composite appliance base for use in the construction of an appliance, comprising:

a base portion;

a fan shroud mounted to said base portion, at least a portion of said fan shroud integrally formed with said base portion;

a first duct in fluid communication with said fan shroud, at least a portion of said first duct integrally formed with said base portion;

a second duct connected to said base portion in proximity to said first duct;

a plurality of motor mounts integrally formed as part of said base portion in proximity to said fan shroud, each of said plurality of motor mounts operable for supporting an electric motor, said electric motor operable for driving a fan located within said fan shroud for circulating air through said first duct and said second duct;

a water inlet mounting formed as part of said base portion operable for connection with a source of water for facilitating the deliver of water to said appliance; and a plurality of cable clips integrally formed as part of said base portion operable for properly positioning cables or wires to said base portion, said cables or wires connected to said electric motor.

27. The composite appliance base for use in the construction of an appliance of claim 26, said fan shroud mounted to said base portion further comprising:

a removable upper portion;

an upper wall formed as part of said removable upper portion;

a semi-circular notch formed as part of said upper wall;

a lower portion integrally formed with said base portion;

a lower wall formed as part of said lower portion and in contact with said upper wall formed as part of said removable upper portion when said removable upper portion is connected to said lower portion; and a semi-circular notch formed as part of said lower wall which forms an aperture with said semi-circular notch formed as part of said upper wall when said removable upper portion is connected to said lower portion, such that said electric motor mounted to said plurality of motor mounts is operable to connect to said fan located in said fan shroud by a shaft extending through said aperture.

28. The composite appliance base for use in the construction of an appliance of claim 27, said first duct further comprising:

a removable upper half integrally formed with said removable upper portion of said fan shroud; and a lower half integrally formed with said base portion and adjacent to said lower portion of said fan shroud such that when said removable upper half of said first duct is assembled to said lower half of said duct and said removable upper portion of said fan shroud is connected to said lower portion of said fan shroud, said first duct is in fluid communication with said fan shroud.

29. The composite appliance base for use in the construction of an appliance of claim 26, said second duct further comprising:

a lower half operable for being connected to said base portion; and an upper half selectively attached to said lower half to form a substantially square-shaped aperture operable for being placed in fluid communication with said first duct for providing circulation of air.

30. The composite appliance base for use in the construction of an appliance of claim 26, further comprising:

a first support member integrally formed as part of said base portion; and a second support member operable for being formed as part of said base portion in proximity to said first support member such that said first support member and said second support member are covered by said lower half of said second duct when said lower half of said second duct is assembled to said base portion.

31. The composite appliance base for use in the construction of an appliance of claim 30, further comprising:

a first top support surface formed as part of said first support member;

a second top support surface formed as part of said second support member; and a backing plate formed as part of said second support member substantially perpendicular to said second top support surface such that said first top support surface, said second top support surface, and said backing plate are operable to support a heating element operable for heating air passing through said second duct.

32. The composite appliance base for use in the construction of an appliance of claim 26, said second duct further comprising a heater box.

33. The composite appliance base for use in the construction of an appliance of claim 26, each of said plurality of motor mounts further comprising a semi-circular recess formed as part of each of said plurality of motor mounts.

34. The composite appliance base for use in the construction of an appliance of claim 26, said water inlet mount further comprising:

a main flange;

an aperture formed as part of said main flange such that a hose in fluid communication with a water supply is operable for being mounted to said aperture formed as part of said main flange; and an offset flange formed as part of said main flange, wherein a valve is operable for being mounted to said offset flange formed as part of said main flange for controlling the flow of fluid through said hose mounted within said aperture.

* * * * *